United States Patent [19]

Cone

[11] Patent Number: 4,836,601

[45] Date of Patent: Jun. 6, 1989

[54] FOLDING CHAIR

[75] Inventor: Richard E. Cone, Dayton, Ohio

[73] Assignee: U.S. Brands, Worthington, Ohio

[21] Appl. No.: 134,850

[22] Filed: Dec. 18, 1987

[51] Int. Cl.[4] ..... A47C 4/00

[52] U.S. Cl. ..... 297/16; 297/45

[58] Field of Search ..... 297/16, 45, 17

[56] References Cited

U.S. PATENT DOCUMENTS

| | | | |
|---|---|---|---|
| 244,216 | 7/1881 | Fenby . | |
| 2,473,090 | 6/1949 | Becker | 297/45 |
| 2,587,543 | 2/1952 | Smith . | |
| 2,691,410 | 10/1954 | Boucher . | |
| 2,916,744 | 12/1959 | May et al. | 297/45 X |
| 3,124,387 | 3/1964 | MacLaren . | |
| 3,136,272 | 6/1964 | Sprigman . | |
| 3,838,883 | 10/1974 | Machen . | |
| 4,014,591 | 3/1977 | Gittings . | |
| 4,148,520 | 4/1979 | Miller | 297/16 |
| 4,605,261 | 8/1986 | Lee | 297/16 |
| 4,671,566 | 6/1987 | Knapp . | |
| 4,685,725 | 8/1987 | Helfrich | 297/45 |

*Primary Examiner*—Peter A. Aschenbrenner
*Attorney, Agent, or Firm*—Donald R. Bahr

[57] ABSTRACT

The subject invention comprises a foldable portable chair which has a seat section and a support section. In the preferred embodiment the seat section is a triangular flexible web which is attached to the upper portions of the support section. The support section is made up of a first and second V shaped supports. These V shaped supports are each formed from two arms which are pivotally connected to each other. The V shaped supports are nested one in each other. The apexes of the V shaped supports are oriented opposite to each other. Lastly the V shaped supports are also interconnected to each other by support means to limit the travel of the V shaped supports and their respective arms in relation to each other.

The chair of this invention is suitable for both juvenile and adult usage.

12 Claims, 3 Drawing Sheets

FOLDING CHAIR

BACKGROUND OF THE INVENTION

1. Field of the Invention

The present invention is concerned with folding chairs which are portable, comfortable, strong and convenient to use. More particularly this invention is concerned with a light weight portable chair unit which is supported by a folding frame and which is adapted to both adult and juvenile usage.

2. Description of the Prior Art

This invention relates to a folding chair and to its related support structure. The prior art is replete with examples of folding chair structures. Folding chairs of a wide variety have been manufactured for over one hundred years.

Examples of pertinent prior art patents are U.S. Pat. Nos. 244,216, 2691,410. 3,136,272, 3,124,387. 4,671,566, 3,838,883 and 4,014,591.

U.S. Pat. No. 244,216 is an example of old prior art in the area of folding chairs. This patent shows a folding chair which is supported on four foldable V shaped supports.

U.S. Pat. No. 2,691,410 illustrates foldable chairs which have both triangular and rectangular bases.

U.S. Pat. No. 3,136,272 discloses a plurality of foldable seats which incorporate pivotally mounted V shaped supports.

U.S. Pat. No. 3,124,387 shows a foldable seat having four legs which are interconnected by V shaped supports.

U.S. Pat. No. 4,671,566 is concerned with a foldable chair which has a triangular base. The support components of the chair are two V shaped supports U.S. Pat. No. 3,838,883 relates to a collapsible chair which has a rectangular base and seat section. The support structure utilized consist of four V shaped supports.

Lastly U.S. Pat. No. 4,014,591 deals with a collapsible chair having a rectangular base and seat section. The support system comprises two pairs of cross braced legs.

A need exist for a comfortable outdoor chair which is suitable for use by sports fans, beach goers, fisherman, hunters and anyone else wishing to sit comfortably out of doors. In order to be practical, an outdoor chair must be capable of being collapsed or folded compactly in order that it can be readily transported and moved from one location to another. Likewise in order to be functional the chair must be light and as such its support structure must be designed in order to efficiently utilize light weight high strength materials. The chair of this invention meets these criteria in that it is comfortable, foldable, strong, lightweight, transportable and easy to use.

As illustrated by the great number of prior patents and commercial seats, efforts have been continuously made in an attempt to produce practical, foldable chairs which are light and strong. None of these prior efforts, however, suggest the present inventive combination of component elements arranged and configured in order to produce a practical foldable chair as is discussed herein below.

The prior art devices do not provide benefits of the present invention which achieves its intended purposes, objectives and advantages over the prior art devices through a new, useful and unobvious combination of component elements, through no increase in the number of functioning parts, at a minimum of cost and through the utilization of only readily available materials and conventional components.

Therefore it is an object of the present invention to provide a foldable seat which is strong and yet lightweight.

It is a further object of this invention to provide a seat which will fold up in such a manner that its main components are in axial relationship with each other.

Lastly it is an object of this invention to provide a stylish seat which is easy to use and yet comfortable for both adult and juvenile usage.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. This invention is concerned with a chair which utilizes two foldable V shaped supports. These V shaped supports form three legs which comprise the main structural element of the chair. The apex of one V shaped support forms one leg. The other two legs are formed by the arms of the other V shaped support.

The width of one V shaped support is slightly narrower than the width of the other V shaped support. This width difference allows one of the V shaped supports to nest inside of the other V shaped support. The two V shaped supports are pivotally connected to each other at the approximate mid points of the arms of each of the V shaped supports.

The arms of each of the V shaped supports are pivotally connected to each other at the apex of the V. This pivotal connection allows the arms of the V shaped supports to be folded inwardly in such a manner that the subject chair can be folded up into a compact package. The base of the chair is a tripod which is formed by the apex of one V shaped support and the two arms of the other V shaped support. Likewise the upper extremity of the chair is a tripod which is formed by the opposite apex and arms of the V shaped supports.

The foldable chair is supported in the open position by two straps, each of which run from the side or apex of one V shaped support to the arms of the other V shaped support. This strapping limits the travel of the apex in relation to the arms. A triangular piece of cloth is further attached to the upper apex and to both upper arms in order to form a seat.

In addition to the strapping, the structure is further supported in the preferred embodiment by a tubular brace which runs between the backside upper extremity of one V shaped support and the backside lower extremity of the opposite V shaped support.

When the V shaped supports are folded into parallel relationship with each other, the support brace in the preferred embodiment folds into parallel relationship with the V shaped supports. Further the upper support strapping and triangular seat fold up in order to produce a compact package which can be placed in a small carrying case. The foldable chair of this invention is manufactured from strapping and tubing, or their equivalents.

By changing the respective dimensions of the components of the chair of this invention it can be adapted to use by either adult or juvenile occupants.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other apparatus for carrying out the same purposes of the present invention. It should also be realized by those skilled in the art that such equivalent apparatus does not depart from the spirit and scope of the invention as set forth in the appended claims.

DESCRIPTION OF THE DRAWINGS

For a more complete understanding of the nature, objects and advantages of the present invention, reference should be had to the following detailed description taken in conjunction with the accompanying drawings in which.

DESCRIPTION OF THE PREFERRED EMBODIMENT

Figure 1:
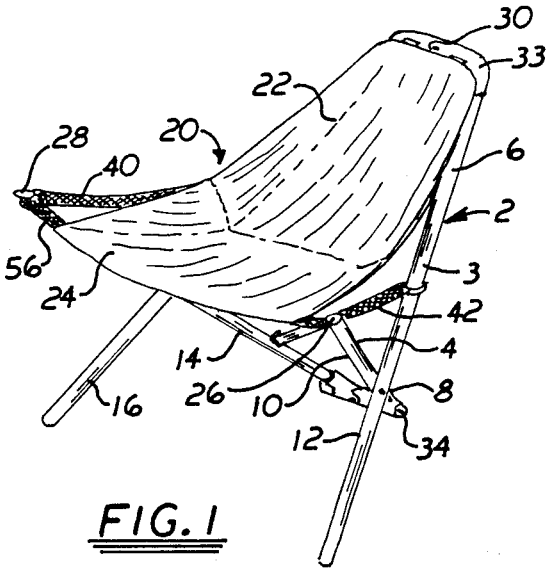
FIG. 1 is a perspective illustration of a foldable chair constructed in accordance with the principles of the present invention.

FIG. 1 is a perspective view showing the foldable chair of this invention and its principle structural parts. The main support frame 3 from chair 2 consist of a first V shaped section 4 and a second V shaped section 6. V shaped section 4 is slightly narrower than V shaped section 6. This difference in width allows V shaped section 4 to nest inside of V shaped section 6.

V shaped section 4 is pivotally connected to V shaped section 6 at point 8 via a pivot pin which passes through arms 10 and 12 of V shaped sections 4 and 6. V shaped sections 4 and 6 further incorporate opposing arms 14 and 16. Arms 14 and 16 are pivotally connected to each other in a manner similar to that described relative to arms 10 and 12.

Figure 2:
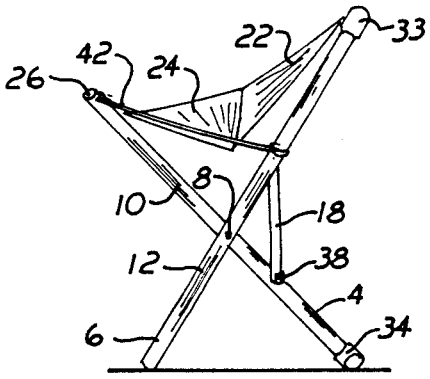
FIG. 2 is a right-hand side elevational view of the foldable chair as shown in FIG. 1.

As can be seen from FIG. 2 pivot point 8 is at the approximate midsection of arms 10 and 12. In this figure additional support brace 18 can be further seen. The function of this brace will be described herein below.

While the main structural support is provided by V shaped sections 4 and 6, the main seating support is provided by a body support 20 which has a back section 22 and a seat section 24. Body support 20 is adapted to fit and give support to the human torso. Body support 20 is attached to the frame which is made up by V shaped sections 4 and 6 at three points. These three attachment points comprise the upper extremities 26 and 28 of arm 10 and 14 and apex 30 of V shaped section 6. This attachment is further illustrated in the rear view of FIG. 3.

In accordance with the preferred embodiment, body support 20 is comprised of a flexible cloth like material such as a cotton duck or a polymeric fabric. The attachment of body support 20 at points 26, and 28 is accomplished by rings and straps as will be described herein below Body support 20 may be a preformed molded shell, not shown, which is adapted to be secured to points 26, 28 and 30 of support frame 3.

When a human body sits in body support 20 a variety of forces are applied to the support frame 3 which is made up of V shaped sections 4 and 6. These forces are in both horizontal and vertical planes.

Arms 12 and 16 of V shaped section 6 are pivotally attached to each other via a U shaped hinge member 33. Likewise arms 10 and 14 of V shaped section 4 are pivotally attached to each other via U shaped hinge member 34. The details of hinge members 33 and 34 will be discussed herein below. Because of the pivotal attachment of pairs of arms 10 and 14 and 12 and 16 when weight is applied to body support 20 downward force causes respective pairs of arms 10 and 14 and 12 and 16 to move inward toward each other. In order to have a functional folding chair this movement of pairs of arms 10 and 14 and 12 and 16 must be restrained. In the preferred embodiment of the foldable chair of this invention this restraint is effected by a brace 18 which is pivotally connected to the upper half of arm 12 at point 32 and to the lower half of arm 14 at point 38.

Figure 3:
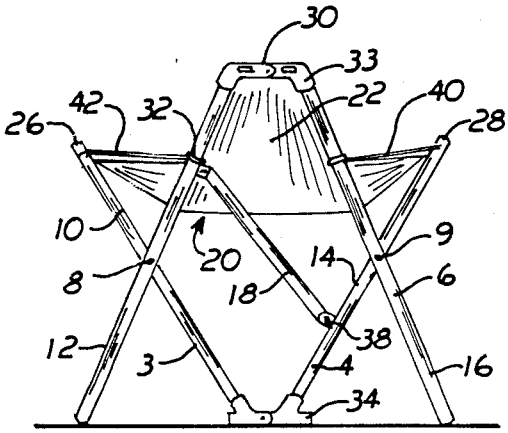
FIG. 3 is a rear view of the foldable chair as shown in FIG. 1.

Because brace 18 is rigid and connected to an opposing arm of each V shaped section, when the support frame 3 is opened as is illustrated in FIG. 3 the pairs of arms 10 and 14 and 12 and 16 automatically spread to the proper seat position. In accordance with the preferred embodiment, the movement of these pairs of arms is so controlled that the front edge of body support 20 is also spread between attachment points 26 and 28.

Figure 10:
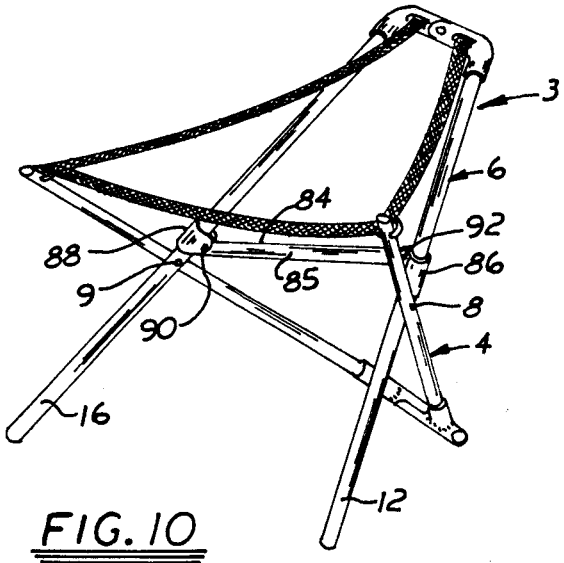
FIG. 10 is a perspective view of the chair frame as used in this invention with an alternate bracing means and alternate strap attachment.
Figure 11:
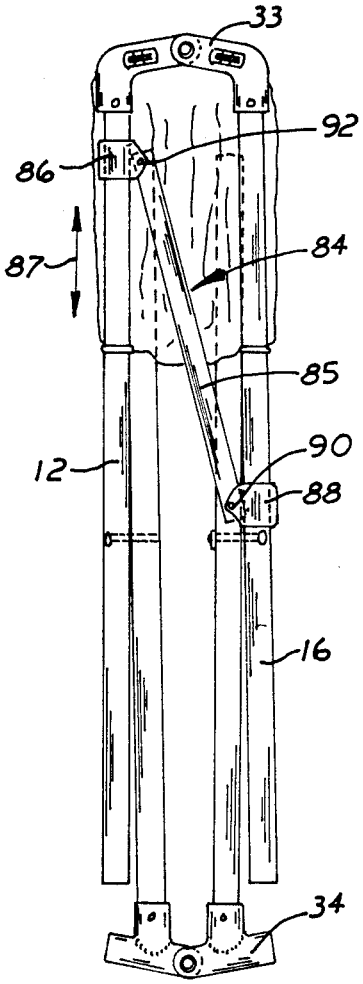
FIG. 11 is a rear view of the foldable chair of this invention in a folded stance with an alternate brace means.

FIGS. 10 and 11 show an alternate structure wherein the movement of the arms of V shaped support sections 4 and 6 are restrained. Brace 84 is an alternate structure for brace 18, the function of which was described herein above. Referring to FIGS. 10 and 11 it can be seen that chair frame 3 generally comprises two V shaped sections 4 and 6 which nest inside each other. V shaped section 6 incorporates a pair of arms 12 and 16. Brace 84 comprises a main body brace section 85 and a pair of attachment bosses 86 and 88. Main body brace section 85 is pivotally connected to attachment bosses 86 and 88 at pivot points 90 and 92. Boss 86 is slideably mounted on arm 12. Attachment boss 86 is mounted above pivot point 8. Attachment boss 88 is fixed on arm 16 and is mounted above pivot point 9. When the composite chair is folded up, as is shown in FIG. 11, brace 84 pivots on attachment bosses 86 and 88 and attachment boss 86 slides up on arm 12. The movement of attachment boss 86 is illustrated by arrow 87. This upward and downward movement allows arms 12 and 16 to fold inward on each other and thereby allowing the chair to fold up into a tubular package. When arms 12 and 16 expand outward, brace 84 approaches a horizontal position and further restricts the outward and inward movement of arms 12 and 14. When brace 84 is in the position as is illustrated in FIG. 10 the composite structure is locked into a rigid frame which provides excellent support for a body support not shown.

Figure 8:
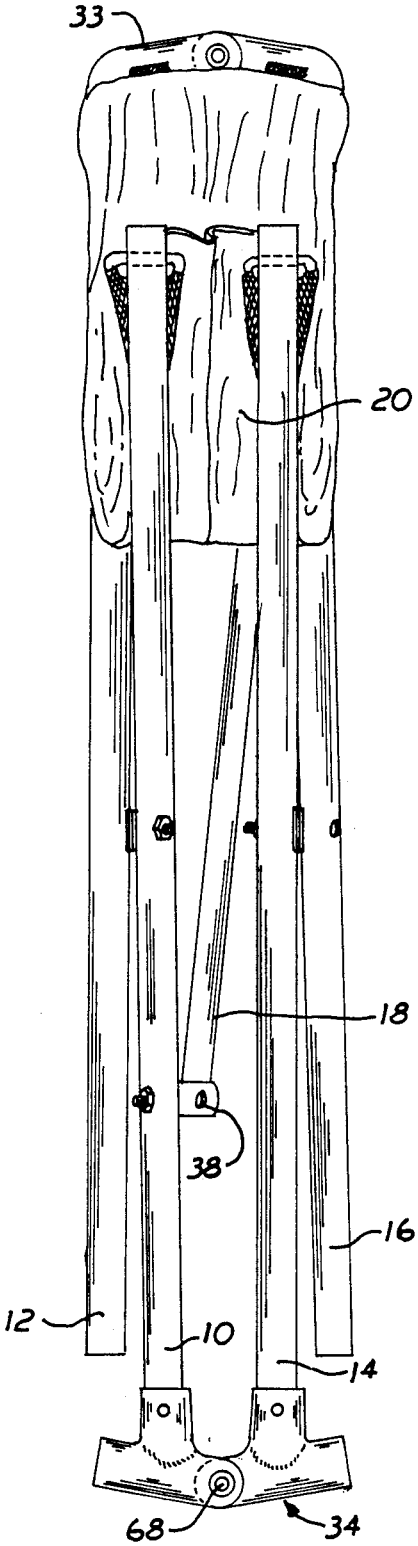
FIG. 8 is a front view of the foldable chair of this invention in a folded stance.
Figure 9:
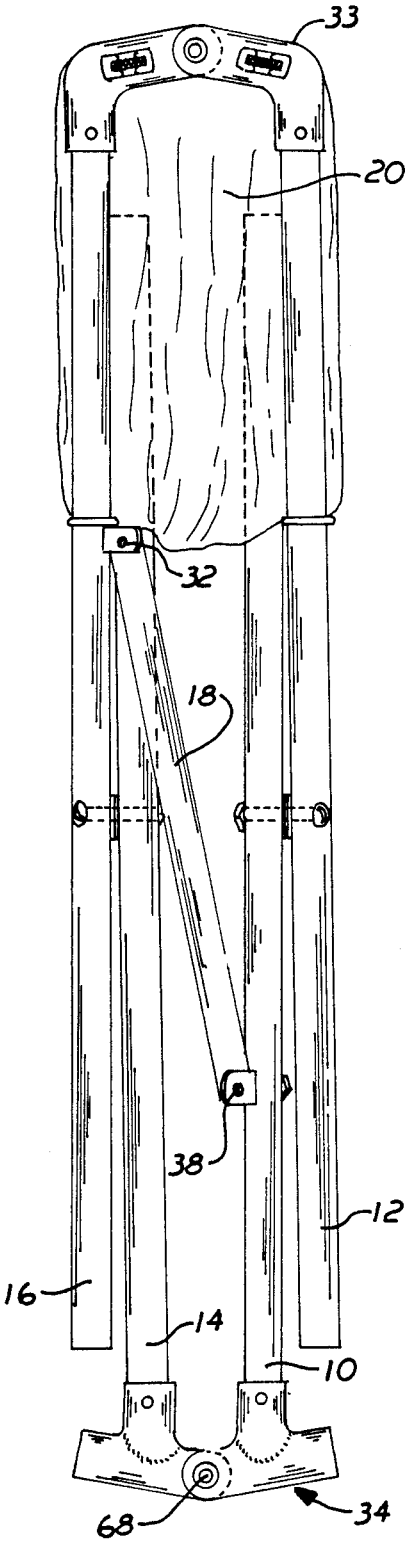
FIG. 9 is a rear view of the foldable chair of this invention in a folded stance.

As can be seen in FIG. 3 the distance between points 9 and 26 and 8 and 32 in the preferred embodiment can be approximately equal and these distances should be such as to allow said composite frame to fold flat as is illustrated in FIGS. 8 and 9. Brace 18 controls the folding action of arms 10, 12, 14 and 16 when the composite structure is changed from a folded to an open stance. Further brace 18 prevents pairs of arms 10 and 12 and 14 and 16 from folding inward or outward when weight is applied to body support 20.

It is evident to one skilled in the art that if support frame 3 is to be functional and provide support for body support 20 the movement of the upper extremities of pairs of arms 10 and 14 and 12 and 16 must be restrained. That is, the movement of points 26 and 28 away from point 30 must be restrained. In order to provide this restraint support frame 3 further incorporates a pair of straps 40 and 42 which effectively limit the travel of points 26 and 28 of arms 10 and 14 away from apex 30 of V shaped section 6. Straps 40 and 42 are advantageous in that when they are pulled taunt by the weight of a person sitting in body support 20, they further function as arm rests. The primary function of straps 40 and 42 is to prevent V shaped frames 4 and 6 from folding flat when weight is applied to body support 20, by the placement of a body therein. In the preferred embodiment, straps 40 and 42 are formed from a high strength webbing material such as woven nylon.

Figure 4:
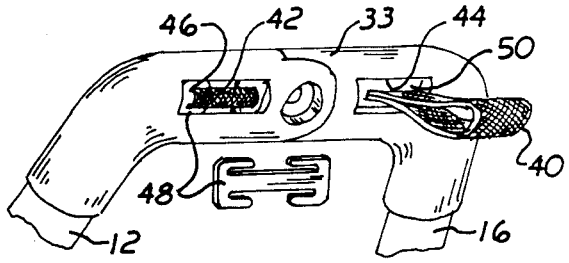
FIG. 4 is a rear elevational view of the top V shaped hinge member as is used in the foldable chair of this invention.

The attachment of straps 40 and 42 to U shaped hinge member 32 is illustrated in FIG. 4. It can be seen that U shaped hinge member 32 incorporates two elongated slots 44 and 46. The ends of straps 40 and 42 are formed into a loop and passed through slot 44. A retaining bracket 48 is then passed through the formed loop. Strap 40 is then pulled forward in such a manner that retaining bracket 48 is lodged in recess 50 which surrounds slot 44. A fully seated and secured strap 42 is shown in slot 46 on the left side of hinge bracket 32.

Figure 5:
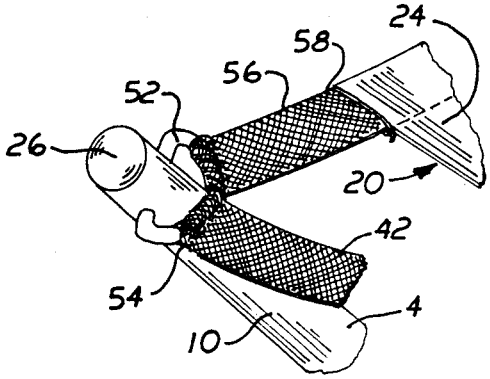
FIG. 5 is an enlarged perspective illustration of the upper front left portion of the foldable chair as shown in the previous figures and illustrating the attachment of support webbing to the V shaped supports.

FIG. 5 shows the means whereby straps 40 and 56 are attached to the upper arms of V shaped section 4. A D ring or formed wire shape 52 is secured in an aperture which is integral with arm 10 of V shaped section 4. The end of strap 42 is sewn into a loop 54, through which is passed D ring 52. D ring 52 is further adapted to receive strap 56 which passes between arms 10 and 14 of V shaped section 4.

The leading edge of body support 20 is sewn into a hem 58 through which is passed strap 56. When arms 10 and 14 are biased outward and forward straps 42 and 56 are pulled taunt. When pressure is applied to support 20 strap 56 is pulled taunt.

By use of straps 40, 42, 56 and brace 18 the components of support frame 3 are locked into a strong lightweight frame for body support 20.

Figure 6:
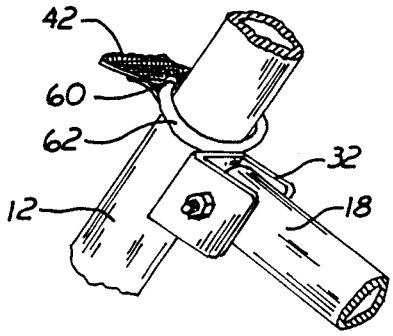
FIG. 6 is an enlarged perspective illustration of the foldable slat as shown in the previous figures illustrating the attaching means for the support strapping.

FIG. 6 shows how strap 42 may be secured to arm 12. In this embodiment a loop 60 is sewn in strap 42 and a ring 62 passed through this loop. Ring 62 is in turn passed around arm 12 and secured near hinge bracket 32.

Figure 7:
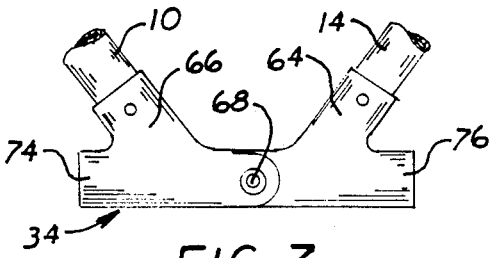
FIG. 7 is a rear view of the lower V shaped hinge member.
Figure 7A:
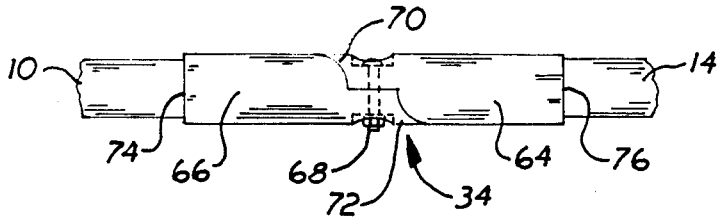
FIG. 7A is an end view of the lower V shaped hinge member of FIG. 7.

FIGS. 4, 7 and 7A illustrate in detail the construction of U shaped hinge members 33 and 34 which are used to connect the arms of the V shaped sections. The construction of U shaped hinge members 33 and 34 is similar in that both are formed from two sections which are pivotally connected to each other. Referring to FIG. 7 it can be seen that U shaped hinge member 34 is constructed from two sections 74 and 76. These sections are connected to each other with a hinge pin 68 which in the illustrated embodiment is a rivet 68.

Referring to FIG. 7A it can be seen that U shaped hinge member 34 is formed from two sections 74 and 76 which in turn have integral arms 70 and 72 which mesh with each other. The clearance between arms 70 and 72 is such that they can pivot around hinge pin 68. U shaped hinge member 34 further has extended support sections 74 and 76 which increase the surface area of U shaped hinge member 34. Since U shaped hinge member 34 engages the ground this additional surface area is advantageous in that it prevents V shaped section 4 from sinking into the ground, when foldable chair 2 supports the weight of a human occupant.

The pivotal construction of upper U shaped hinge member 33 is similar to that described above for U shaped hinge member 34.

Arms 10, 12, 14 and 16 in accordance with the preferred embodiment are formed from a continuous piece of hollow tubing.

FIGS. 8 and 9 show the chair of this invention folded into a compact tubular package. It should be noted from these Figures that brace 18 folds into approximate parallel relationship with arms 10, 12, 14, and 16. Further when folded body support 20 folds into a compact package around the upper extremities of folded support frame 3.

Figure 12:
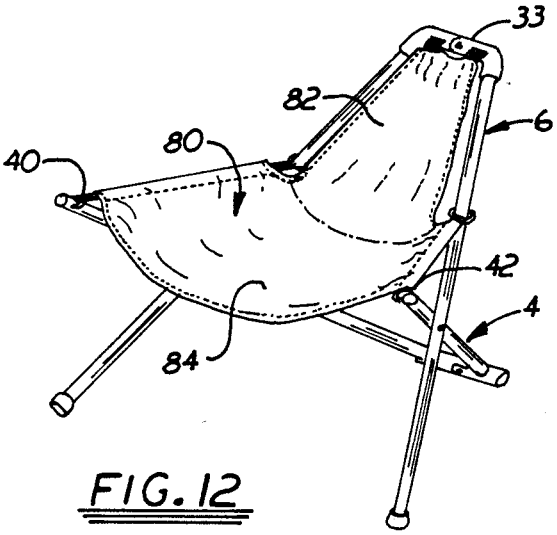
FIG. 12 is a perspective view of the foldable chair of this invention showing an alternate body support.

FIG. 12 shows still another embodiment of the portable chair in accordance with this invention wherein an alternate body support may be utilized. In this structure body support 80 has a back section 82 and a seat section 84. Back section 82 is attached to hinge member 33 in a manner as described above in reference to body support 20. In order to provide a wider seating area the lateral edges of seat section 84 are sewn over and around straps 40 and 42. As a result of this construction, seat section 84 has an enhanced seating area and it further has a comfortable U shaped cross section. The sides of this U shaped cross section are advantageous in that they provide comfortable support to the thighs of a human occupant.

It is evident from FIGS. 1-11 and from the above description that the two V shaped sections with the supporting braces and body support form a lightweight, foldable, strong, convenient chair structure.

The present disclosure includes that information contained in the appended claims as well as that in the foregoing description. Although the invention has been described in its preferred form or embodiment with a certain degree of particularity, it is understood that the present disclosure of the preferred form has been made only by way of example and that numerous changes in the details of construction, fabrication and use including the combination and arrangement of parts, may be resorted to without departing from the spirit and scope of the invention.

What is claimed is:

1. A foldable, portable chair comprising: a seat portion for supporting a human torso, a support portion operatively connected to said seat portion, wherein said support portion comprises a first and a second foldable V shaped section, each V shaped section having a pair of arms, the arms of the first V shaped section being pivotally connected to the arms of the second V shaped section at their midsections, the apex of the first V shaped section being downwardly depending and the apex of the second V shaped section being upwardly depending, wherein said first and second V shaped sections are further interconnected to each other via at least one brace means which restrains the pivotal movement of the arms of said first and second V shaped sections and a means for limiting the extent to which said first and second V shaped sections can move in relation to each other.

2. The foldable portable chair of claim 1 wherein said brace means comprises a rigid member which is pivotally connected to the upper extremity of one arm of the first V shaped section and the lower extremity of one arm of the second V shaped section.

3. The foldable portable chair of claim 1 wherein said seat portion comprises a triangular web.

4. The foldable portable chair of claim 1 wherein the means for limiting the extent to which the first and second V shaped sections can move in relation to each other comprises a pair of flexible straps which connect said V shaped sections.

5. The foldable portable chair of claim 1 wherein the means for limiting the extent to which the arms of the first and second V shaped sections can move in relation to each other comprises at least one foldable member, the terminal ends of which are connected to the lower portion of an arm of the first V shaped section and to the upper portion of an arm of the second V shaped section.

6. The foldable portable chair of claim 1 wherein said seat portion comprises a triangular flexible material which is secured to the upper portion of the second V shaped section and to the upper arms of the first V shaped section.

7. The foldable, portable chair of claim 1 wherein said seat portion comprises a preformed removeable shell, one end of which is secured to the apex of the second V shaped section, the other ends being connected to arms of the first V shaped section.

8. The foldable portable chair of claim 1 wherein, the arms of each of the V shaped section are pivotally connected to each other at the apexes of said V shaped sections.

9. The foldable portable chair of claim 8 wherein terminal ends of the arms of each of the V shaped sections incorporate apertures, pairs of arms being pivotally connected to each other by pins which pass through said apertures.

10. The foldable portable chair of claim 8 wherein the terminal ends of the arm of each of the V shaped sections are connected to a two piece U shaped hinge member the pieces of which are pivotally connected to each other.

11. The foldable portable chair of claim 8 wherein the U shaped hinge members comprise opposing, meshing sections which are pivotally connected by a pin which passes through said meshing sections.

12. A foldable portable chair comprising;

a flexible seat which is adapted to receive and support a human torso;

a support portion which comprises first and second V shaped sections having two arms each;

said first and second V shaped sections being nested one within each other and being pivotally connected to each other at the approximate midsections of said arms;

the apex of the first V shaped section being downward and the apex of the second V shaped section being upward;

the arms of the first V shaped sections spreading upward when opened and the arms of the second V shaped section spreading downward when open;

the flexible seat portion being attached to the upper portion of the second V shaped section and to the upper arms of the first V shaped section;

and the arms of each of the V shaped sections are connected to each other by meshing sections of U shaped hinge members which are pivotally connected to each other by a pin which passes through said meshing sections.

* * * * *